US007350530B2

(12) United States Patent
Lisciandro et al.

(10) Patent No.: US 7,350,530 B2
(45) Date of Patent: Apr. 1, 2008

(54) ASYMMETRIC UMBRELLA

(75) Inventors: Donna Lisciandro, New York, NY (US); Hyuk Hur, New York, NY (US); Jane De Navi, New York, NY (US)

(73) Assignee: Dry Rain, LLC, New York, NY (US)

( * ) Notice: Subject to any disclaimer, the term of this patent is extended or adjusted under 35 U.S.C. 154(b) by 238 days.

(21) Appl. No.: 10/977,290

(22) Filed: Oct. 29, 2004

(65) Prior Publication Data

US 2006/0090781 A1 May 4, 2006

(51) Int. Cl.

| | |
|---|---|
| ***A45B 11/00*** | (2006.01) |
| ***A45B 23/00*** | (2006.01) |
| ***A45B 25/00*** | (2006.01) |
| ***A45B 19/10*** | (2006.01) |

(52) U.S. Cl. ..... 135/20.1; 135/25.3; 135/25.31

(58) Field of Classification Search ..... 135/20.1, 135/25.3, 25.31, 25.32, 32; D3/5, 16
See application file for complete search history.

(56) References Cited

U.S. PATENT DOCUMENTS 1,053,337 A * 2/1913 Williams ..... 135/20.1
2,707,476 A * 5/1955 Clemens ..... 135/20.1

(Continued)

FOREIGN PATENT DOCUMENTS

DE 447684 * 10/1928

(Continued)

OTHER PUBLICATIONS

International Preliminary Report on Patentability for PCT/U2005/032688, dated Oct. 25, 2006.

(Continued)

*Primary Examiner*—David Dunn
*Assistant Examiner*—Danielle Jackson
(74) *Attorney, Agent, or Firm*—Fish & Richardson P.C.

(57) ABSTRACT

An umbrella that includes a canopy, a shaft eccentrically disposed beneath the canopy, a runner slidably mounted on the shaft and slidable between a first position, in which the canopy is collapsed, and a second position, in which the canopy is extended, and rib assemblies forming a canopy supporting frame. Each of the rib assemblies are coupled to the apex of the shaft at a proximal end and to the canopy at a distal end. The rib assemblies include a short main rib assembly having a deployment arm and a rib. In the short main rib assembly, the deployment arm is coupled to the runner and to the rib, and the rib is coupled to the shaft apex and to the deployment arm. The rib assemblies also include a long main rib assembly having a deployment arm, a proximal rib, a connecting arm, and a distal rib. In the long main rib assembly, the deployment arm is coupled to the runner and to the proximal rib, the proximal rib is coupled at one end to the shaft apex and at another end to the connecting arm, and the connecting arm is coupled to the proximal rib and to the distal rib. The distal end of each of the rib assemblies points in the same direction when the canopy is collapsed. The short main rib assembly deployment arm and the long main rib assembly deployment arm are of substantially equal length.

45 Claims, 5 Drawing Sheets

U.S. PATENT DOCUMENTS

| | | | | | |
|---|---|---|---|---|---|
| 2,948,289 | A | * | 8/1960 | Owczarek | 135/20.1 |
| 3,042,055 | A | | 7/1962 | Todorovic | 135/20 |
| 4,474,200 | A | | 10/1984 | Kida | 135/20 R |
| 4,474,201 | A | | 10/1984 | Kida | 135/20 R |
| 5,505,221 | A | | 4/1996 | Gao | 135/20.1 |
| D419,759 | S | | 2/2000 | Goudarzi | D3/5 |
| D437,109 | S | | 2/2001 | Muscella | D3/5 |
| 6,196,244 | B1 | | 3/2001 | Haddad et al. | 135/29 |

FOREIGN PATENT DOCUMENTS

| | | | | |
|---|---|---|---|---|
| FR | 912897 | | * | 8/1946 |
| FR | 2598895 | A1 | * | 11/1987 |
| GB | 238820 | | * | 8/1925 |
| JP | 1-221103 | A | * | 9/1989 |
| JP | 2003-310319 | A | * | 11/2003 |
| WO | WO-96/18319 | A1 | * | 6/1996 |
| WO | WO-99/44458 | A1 | * | 9/1999 |
| WO | WO-00/44255 | A1 | * | 8/2000 |
| WO | 2006/132525 | | | 12/2006 |

OTHER PUBLICATIONS

Senz Umbrellas, www.senzumbrellas.com web printout, Feb. 13, 2007.

* cited by examiner

ASYMMETRIC UMBRELLA

BACKGROUND OF THE INVENTION

1. Field of the Invention

The present invention relates to umbrellas. More specifically, the present invention relates to an asymmetric umbrella having an off-center shaft.

2. Description of the Prior Art

Umbrellas conventionally comprise of a center shaft from which a plurality of ribs of equal length are pivotally attached. The ribs extend radially outwards forming a symmetrical frame supporting a canopy. The disadvantage of a conventional umbrella having a center shaft is that it divides the canopy space, forcing the user to be displaced to the perimeter of the canopy. Due to this displacement, conventional umbrellas provide inadequate shelter, exposing the users' side and back to the elements. Moreover, the unused canopy space, particularly of larger umbrellas, makes walking difficult on busy sidewalks.

Asymmetrical umbrellas are known. Asymmetrical umbrellas provide an off-center shaft, thereby allowing the user to stand beneath the center of the umbrella canopy, thereby providing greater protection from the elements. For example, U.S. Pat. Nos. 4,474,201 and 4,474,200 to Kida disclose umbrellas having an oval canopy and an asymmetrically disposed shaft. However, the asymmetrical umbrellas disclosed by the Kida references have a canopy that is functionally inferior to conventional umbrella canopies. Specifically, the Kida umbrella canopies are loosely and unsightly bunched about the frame when the frame is in the closed position.

Patent WO9944458, to Goudarzi discloses an asymmetrical umbrella having ribs of equal length when the umbrella is in the folded position. The Goudarzi design is functionally inferior to conventional umbrellas because when the umbrella is in the folded position several of the distal ribs of the long main ribs fold upwards in an inverted fold, while several short main ribs point downwards. The inverted fold is structurally weak and is inadequate to fully extend the umbrella canopy when in the open position. Moreover, when the umbrella of Goudarzi is in the closed position, the upwardly folding long distal ribs are exposed. The exposed upwardly folding long distal ribs are unsightly and are subject to damage.

U.S. Pat. No. 5,505,221 to Gao discloses an asymmetrical umbrella having telescoping deployment arms of varying lengths. The Gao umbrella is also inferior to conventional umbrellas. Telescoping deployment arms weaken the overall structure of the umbrella, as telescoping components are easily subject to bending and breaking, thereby rendering the umbrella inoperable. Moreover, the umbrella of Gao has distal ribs of graded length to offset the shaft and maintain a circular canopy shape when opened. Thus, when the Gao umbrella is in the closed position, the distal ribs terminate unevenly, resulting in an awkward appearance.

Asymmetrical umbrellas known in the art have been awkward in usability and stowage. The disadvantages are most evident when the umbrellas are closed, displaying uneven distal rib lengths, some of which point up as well as down, or telescoping and slidable ribs which are not only costly to construct and easily broken, but create unsightly bunching of the canopy.

Thus, a need exists for an improved asymmetric umbrella having distal ends that point in the same direction when the canopy is collapsed. A need further exists for an asymmetric umbrella having rib assemblies of substantially uniform length when the canopy is collapsed.

SUMMARY OF THE INVENTION

It is an object of the present invention to provide an asymmetric umbrella.

It is another object of the present invention to provide an asymmetric umbrella comprising: a canopy; a shaft eccentrically disposed beneath said canopy; a runner slidably mounted on said shaft and slidable between a first position.

It is yet another object of the present invention to provide an asymmetric umbrella wherein the distal ends of each of said rib assemblies points in the same direction when said canopy is collapsed.

It is a further object of the present invention to provide an asymmetric umbrella wherein the plurality of rib assemblies are of substantially uniform length when said canopy is collapsed.

It is a still further object of the present invention to provide an asymmetrical umbrella that is collapsed and extended as easily and uniformly as conventional compact umbrellas.

These and other objects, and advantages of the present invention are achieved by an asymmetric umbrella comprising: a canopy; a shaft eccentrically disposed beneath said canopy; a runner slidably mounted on said shaft and slidable between a first position, wherein said canopy is collapsed, and a second position, wherein said canopy is extended; and a plurality of rib assemblies forming a canopy supporting frame, each of said rib assemblies being coupled to the apex of said shaft at a proximal end and fixed to said canopy and at a distal end, wherein the distal ends of each of said rib assemblies points in the same direction when said canopy is collapsed, and wherein said plurality of rib assemblies are of substantially uniform length when said canopy is collapsed.

BRIEF DESCRIPTION OF THE DRAWINGS

The above and other objects, advantages and benefits of the present invention will be understood by reference to the detailed description provided below and the accompanying drawings.

DESCRIPTION OF THE PREFERRED EMBODIMENTS

Figure 1:
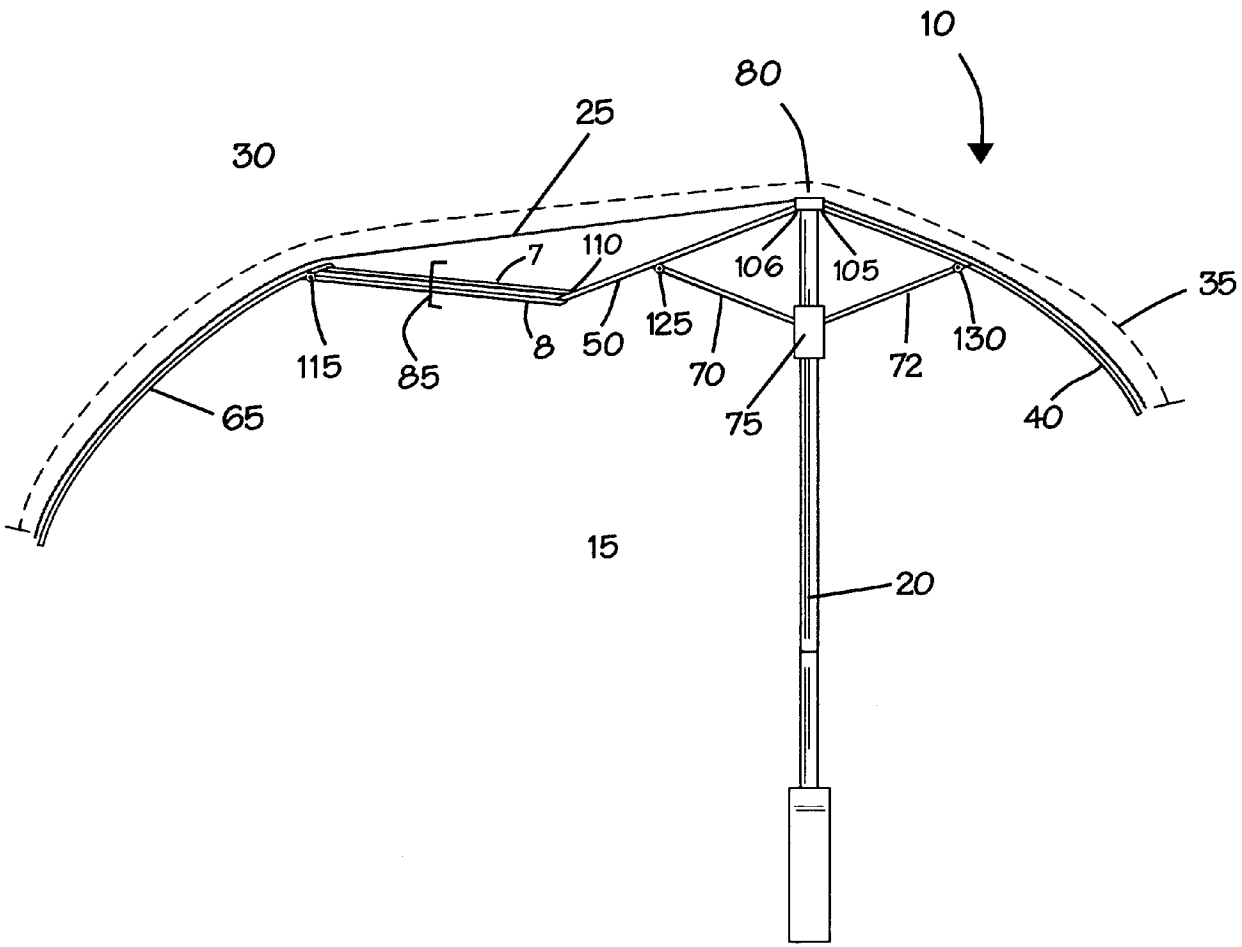
FIG. 1 is a sectional view of a first embodiment of the asymmetric umbrella of the present invention.

Referring to the drawings, and in particular to FIG. 1, there is provided a first embodiment of an asymmetrical umbrella according to the present invention generally represented by numeral 10. Umbrella 10 includes a shaft 20, a slidable runner 75, a canopy 25, and a canopy support frame 15. Shaft 20 is preferably disposed eccentrically beneath canopy 25. Slidable runner 75 is movably mounted on shaft 20 and is slidable between a first position, wherein said canopy is collapsed, as illustrated in FIG. 3A, and a second position, wherein said canopy is extended, as illustrated in FIGS. 2C, 3B and 3C.

Referring again to FIG. 1, support frame 15 comprises a plurality of rib assemblies. Support frame 15 preferably has at least one short main rib assembly 35 and at least one long main rib assembly 30. Each of short main rib assembly 35 and long main rib assembly 30 is coupled to the apex 80 of shaft 20 at a proximal end and fixed to canopy 25 at a distal end. In a preferred embodiment, support frame 15 has four short main rib assemblies 35 and four long main rib assemblies 30. More preferably, at least two of long main rib assemblies 30 are greater than twice the length of short main ribs 35. Short main rib assemblies 35 and long main rib assemblies 30 act to raise canopy 25 to the extended position in a smooth and continuous motion and to lower cahopy 25 to the collapsed position in a smooth and continuous motion. Any coupling means known in the art may be employed, however it is preferable that all couplings of short main rib assemblies 35 and long main rib assemblies 30 are pivotal couplings, thereby enabling smooth function of support frame 15.

Figure 3A:
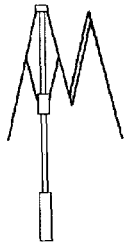
FIG. 3A is a sectional view of a first embodiment of the asymmetric umbrella illustrated in FIG. 1 in the collapsed position.
Figure 3B:
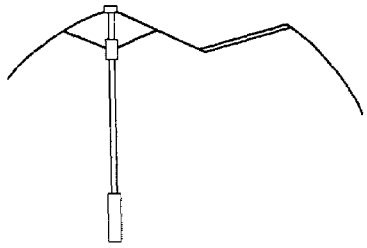
FIG. 3B is a sectional view of a first embodiment of the asymmetric umbrella illustrated in FIG. 1 in the extended position.
Figure 3C:
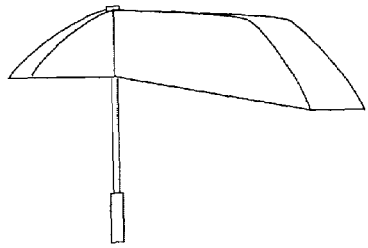
FIG. 3C is a side perspective view of a first embodiment of the asymmetric umbrella illustrated in FIG. 1 in the extended position.
Figure 4A:
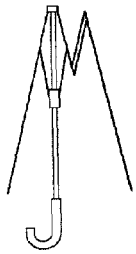
FIG. 4A is a sectional view of a second embodiment of the asymmetric umbrella of the present invention in the collapsed position.

As illustrated in FIGS. 3*a* and 4*a*, the distal ends of each of short main rib assemblies 35 and long main rib assemblies 30 point in the same direction when canopy 25 is in the collapsed position. Preferably, the distal ends of each of the short main rib assemblies 35 and long main rib assemblies 30 point in the downward direction when canopy 25 is collapsed. More preferably, the distal ends of each of short main rib assemblies 35 and long main rib assemblies 30 are of substantially uniform length when canopy 25 is in the collapsed position, thereby maintaining the look of a conventional umbrella.

Figure 2A:
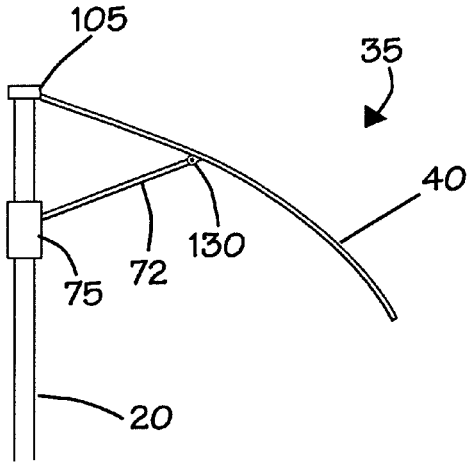
FIG. 2A is a sectional view of the short main rib of a first embodiment of the asymmetric umbrella of the present invention illustrated in FIG. 1.

Referring to FIGS. 1 and 2A, short main rib assembly 35 has a deployment arm 72 and a proximal rib 40. Deployment arm 72 is coupled to runner 75 on a first end thereof and to proximal rib 40 on a second end thereof. Proximal rib 40 is coupled to the apex 80 of shaft 20 at a joint 105 and to deployment arm 72 by any suitable means known in the art. Proximal rib 40 is fixedly attached to canopy 25. Joint 105 is preferably a pivotal connection. Short main rib assembly 35 may optionally have a distal short rib 45 (not shown) connected to proximal rib 40. Any coupling means known in the art may be employed, however it is preferable that all couplings of short main rib assemblies 35 and long main rib assemblies 30 are pivotal couplings.

Figure 2B:
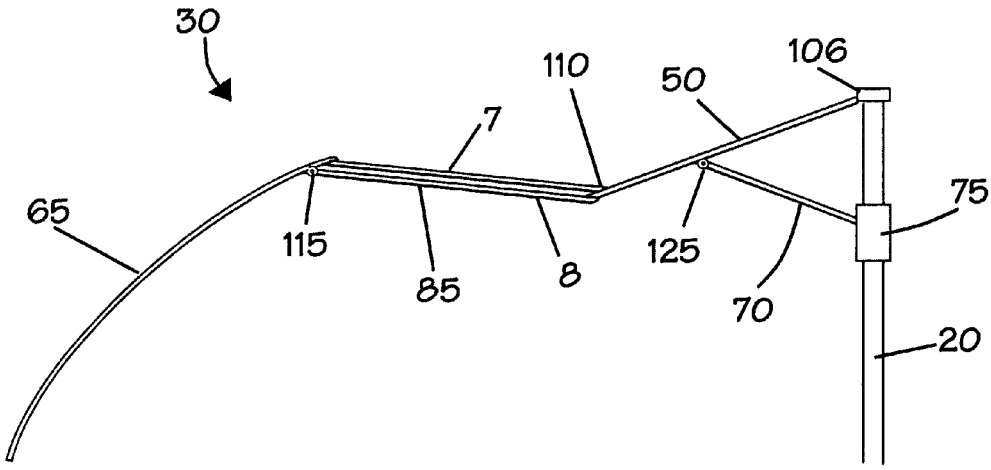
FIG. 2B is a sectional view of the long main rib of a first embodiment of the asymmetric umbrella of the present invention illustrated in FIG. 1.
Figure 2C:
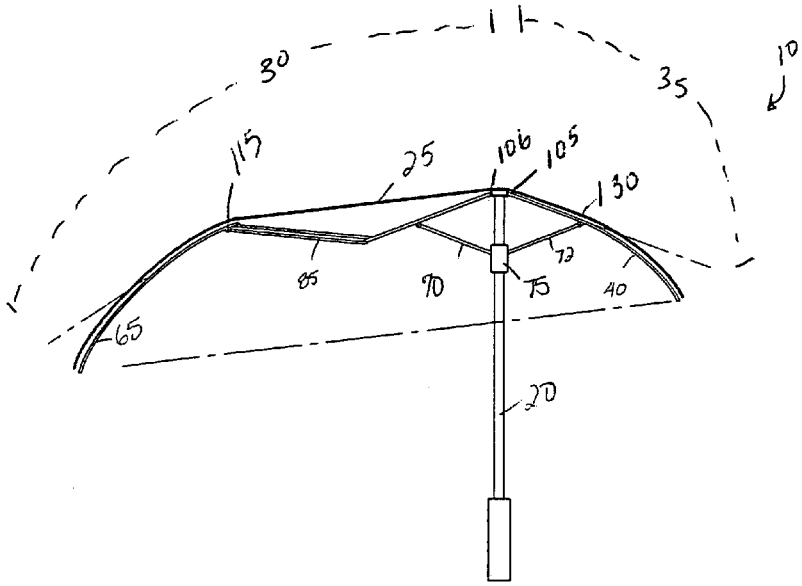
FIG. 2C is a sectional view illustrating the angled canopy of the asymmetrical umbrella of FIG. 1.
Figure 2D:
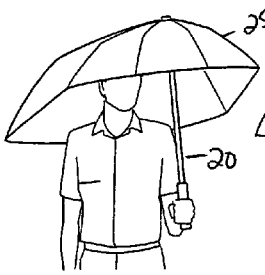
FIG. 2D is a front perspective view of the asymmetric umbrella of FIG. 1.
Figure 2E:
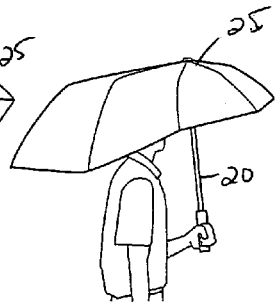
FIG. 2E is a side perspective view of the asymmetric umbrella of FIG. 1.
Figure 2F:
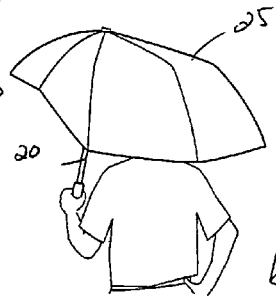
FIG. 2F is a rear perspective view of the asymmetric umbrella of FIG. 1.
Figure 2G:
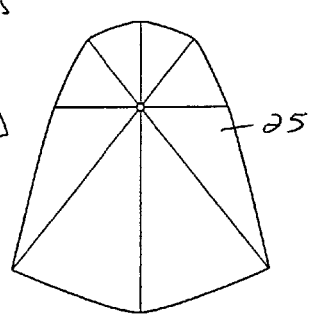
FIG. 2G is a top elevational view of the asymmetric umbrella of FIG. 1.

Referring to FIGS. 1 and 2B, long main rib assembly 30 has a deployment arm 70, a proximal rib 50, a hinge joint 85, and a distal rib 65. Deployment arm 70 is coupled to slidable runner 75 and to proximal rib 50. Proximal rib 50 is coupled to the apex 80 of shaft 20 at a joint 106 and to hinge joint 85 at a joint 110. Hinge joint 85 is coupled to proximal rib 50 and to distal rib 65. Hinge joint 85 is coupled to distal rib 65 at a joint 115. Distal rib 65 is fixedly attached to canopy 25. Hinge joint 85 is preferably a quadrilateral hinge joint having a connecting arm 8 and a support rib 7. Connecting arm 8 is preferably disposed in parallel relation to support rib 7. Any coupling means known in the art may be employed, however it is preferable that all couplings of short main rib assemblies 35 and long main rib assemblies 30 are pivotal couplings.

An elongate canopy 25 may be provided by employing a support frame 15 configuration having a long main assembly 30, wherein proximal rib 50, connecting arm 8 and support rib 7 are shorter in length than distal rib 65.

Deployment arms 70 and 72 are preferably of equal length. Deployment arm 70 is preferably pivotally connected to proximal rib 50 to form a joint 125. Joint 125 is preferably a pivotal connection and is preferably disposed along proximal rib 50 at a mid-point thereof. Deployment arm 72 is preferably pivotally connected to proximal rib 40 to form a joint 130. Joint 130 is preferably a pivotal connection and is preferably disposed along proximal rib 40 at a mid-point thereof. Joints 125 and 130 are preferably symmetrically positioned to form equal triangular deployment hinges between proximal rib 50 and deployment arm 70 and proximal rib 35 and deployment arm 72.

The distance between joints 105 and 130 is preferably less than half of the distance between joint 106 and joint 115. Thus, shaft 20 is disposed beneath canopy 25 at a position that is greater than one-half of the length of canopy 25 at its widest point. More preferably, shaft 20 is disposed beneath canopy 25 at a position that is greater than two-thirds of the length of the canopy at its widest point. As illustrated in FIG. 2D, 2E, 2F and 2G, offset shaft 20 allows a user to be positioned directly beneath the center of canopy 25, thereby providing more even canopy coverage and improved protection from the elements. Additionally, the increased space of canopy 25 between joints 106 and 115 acts to ease tension between the tip of proximal rib 40 and joint 115 when umbrella 10 is extended and collapsed. Accordingly, smooth folding movement between extended and collapsed positions of canopy 25 is achieved.

Referring to FIG. 2C, canopy 25 aids the flexion of short main rib assemblies 35 and long main rib assemblies 30, thereby increasing the angle of canopy 25 off the horizontal plane when umbrella 10 is in the extended position. Canopy

25 actively flexes the distal ends of short main rib assemblies 35 and long main rib assemblies 30 to increase the elevation of canopy 25 off the horizontal plane when canopy 25 is extended. Flexion of the distal ends of short main rib assemblies 35 and long main rib assemblies 30 is preferably about 20° from their normal position. The angle formed by canopy 25 and the horizontal plane is preferably about 8°. The angle formed by canopy 25 and the horizontal plane provides greater protection from the elements to the user.

Figure 4B:
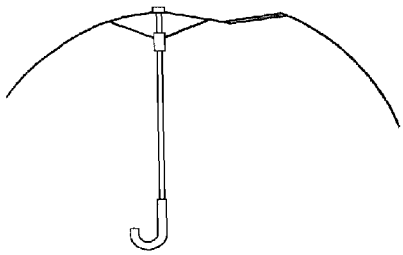
FIG. 4B is a sectional view of a second embodiment of the asymmetric umbrella of the present invention in the extended position.
Figure 4C:
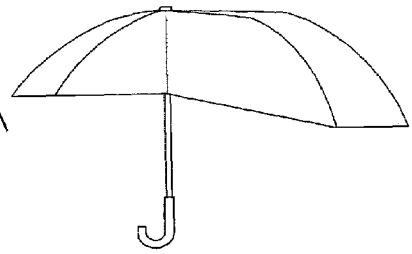
FIG. 4C is a side perspective view of a second embodiment of the asymmetric umbrella of the present invention in the extended position.

It should be noted that an umbrella that is similar in appearance to a traditional cane umbrella, as illustrated in FIGS. 4A, 4B and 4C, may be provided by adding extensions to distal ribs 65 and proximal ribs 40.

Figure 5A:
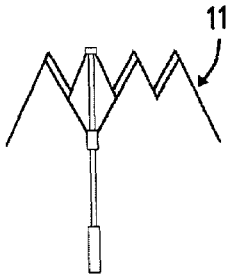
FIG. 5A is a sectional view of a third embodiment of the asymmetric umbrella of the present invention in the collapsed position.
Figure 5B:
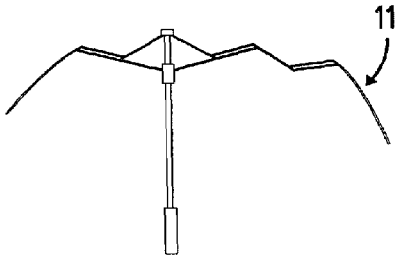
FIG. 5B is a sectional view of a third embodiment of the asymmetric umbrella of the present invention in the extended position.
Figure 5C:
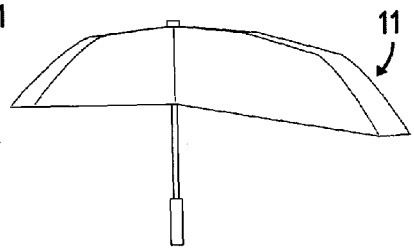
FIG. 5C is a side perspective view of a third embodiment of the asymmetric umbrella of the present invention in the extended position.
Figure 6:
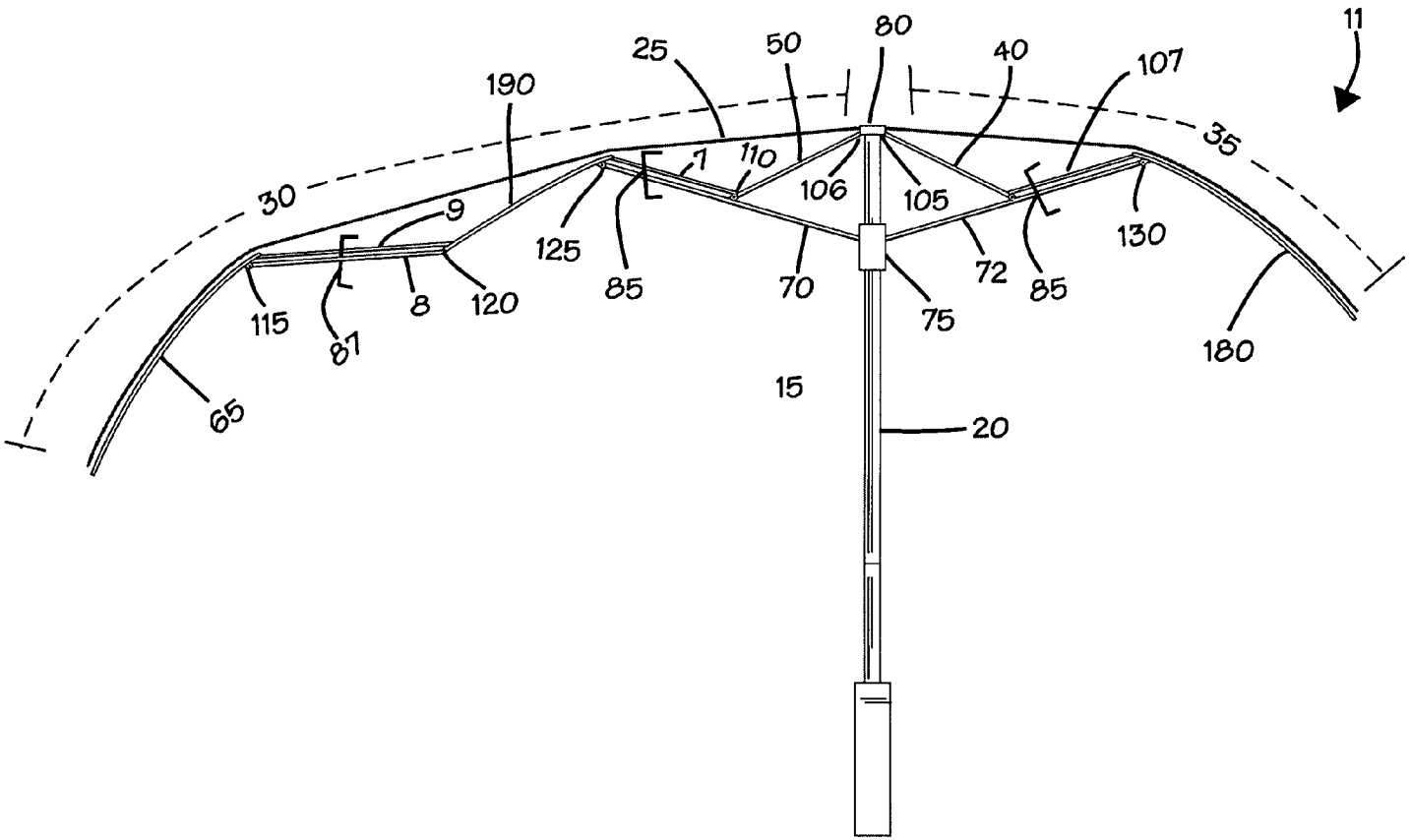
FIG. 6 is a sectional view of the third embodiment of the asymmetric umbrella of the present invention in the extended position.

An alternate embodiment of the present invention represented by reference numeral 11 in FIGS. 5A, 5B, 5C and 6 provides an umbrella having a full-sized canopy that is substantially more compact when in the collapsed position. Referring to FIG. 6, umbrella 11, similar in structure and function to the first described embodiment, includes a shaft 20, a slidable runner 75, a canopy 25, and a canopy support frame 15. Shaft 20 is preferably disposed eccentrically beneath canopy 25. Slidable runner 75 is movably mounted on shaft 20 and is slidable between a first position, wherein said canopy is collapsed, as illustrated in FIG. 5A, and a second position, wherein said canopy is extended, as illustrated in FIGS. 5B and 5C.

Similar to the first described embodiment, umbrella 11 has a support frame 15, which comprises a plurality of rib assemblies. Support frame 15 preferably has at least one short main rib assembly 35 and at least one long main rib assembly 30. Each of short main rib assembly 35 and long main rib assembly 30 is coupled to the apex 80 of shaft 20 at a proximal end and fixed to canopy 25 at a distal end.

As illustrated in FIG. 5*a*, the distal ends of each of short main rib assemblies 35 and long main rib assemblies 30 point in the same direction when canopy 25 is in the collapsed position, as in the above-described embodiment. Preferably, the distal ends of each of the short main rib assemblies 35 and long main rib assemblies 30 point in the downward direction when canopy 25 is collapsed. More preferably, the distal ends of each of short main rib assemblies 35 and long main rib assemblies 30 are of substantially uniform length when canopy 25 is in the collapsed position, thereby maintaining the look of a conventional umbrella.

The more compact canopy support frame 15 of umbrella 11 provides a two-rib configuration for each short main rib assembly 35 and a four-rib configuration for each long main rib assembly 30. All ribs of umbrella 11 are proportionately shorter than the ribs of the above-described embodiment, while deployment arms 70 and 72 are proportionately longer than the ribs of the above-described embodiment.

Referring again to FIG. 6, short main rib assembly 35 has a deployment arm 72, a proximal rib 40, a support rib 7 and a distal rib 180. Deployment arm 72 is coupled to runner 75 on a first end thereof and to distal rib 180 at a distal end thereof. Proximal rib 40 is coupled to the apex 80 of shaft 20 at a joint 105, to deployment arm 72 at approximately a mid-point thereof, and to support rib 107. Support rib 107 extends along a portion of and parallel to deployment arm 72. Support rib 107 and deployment arm 72 are coupled at their distal ends to distal rib 180. Support rib 107 and deployment arm 72 form a hinge joint 85. Hinge joint 85 is preferably a quadrilateral hinge joint. Distal rib 180 is fixedly attached to canopy 25. Any coupling means known in the art may be employed, however it is preferable that all couplings of short main rib assemblies 35 and long main rib assemblies 30 are pivotal couplings.

Long main rib assembly 30 has a deployment arm 70, a proximal rib 50, a first hinge joint 85, a shortened distal rib 190, a second hinge joint 87 and a distal rib 65. Deployment arm 70 is coupled to slidable runner 75 at a first end thereof and to shortened distal rib 190 at a distal end thereof. Proximal rib 50 is coupled to the apex 80 of shaft 20 at a joint 106, to deployment arm 70 at approximately a mid-point thereof, and to a support rib 7 at a joint 110. Support rib 7 extends along a portion of and parallel to deployment arm 70. Support rib 7 and deployment arm 70 are coupled at their distal ends to the proximal end of shortened distal rib 190, forming a joint 125. Support rib 7 and deployment arm 70 form hinge joint 85. Hinge joint 85 is preferably a quadrilateral hinge joint. Shortened distal rib 190 is coupled at its distal end to second hinge joint 87, forming a joint 120. Hingejoint 87 is preferably a quadrilateral hinge joint having a connecting arm 8 and a second support rib 9. Connecting arm 8 is preferably disposed in parallel relation to second support rib 9. Distal rib 65 is coupled at a proximal end thereof to second hinge joint 87, forming joint 115. Distal rib 65 is fixedly attached to canopy 25. Any coupling means known in the art may be employed, however it is preferable that all couplings of short main rib assemblies 35 and long main rib assemblies 30 are pivotal couplings.

To ensure that shaft 20 is disposed greater than two-thirds across the length of canopy 25 at its widest point, the length of distal rib 65 is shortened by approximately one third. Connecting arm 8 and second support rib 9 of second hinge joint 87 are likewise shortened to approximately the length of distal rib 65.

In a preferred embodiment of the present invention, distal rib 65 and distal rib 180 are preferably formed of a material that is lighter in weight than the material of the remaining ribs of canopy support frame 15. The lightweight material of distal rib 65 and distal rib 180 provides greater flexibility to canopy support frame 15.

All embodiments of the present invention may employ manual or automatic unfolding mechanisms.

The present invention having been thus described with particular reference to the preferred forms thereof, it will be obvious that various changes and modifications may be made therein without departing from the spirit and scope of the present invention as defined in the appended claims.

What is claimed is:

1. An asymmetric umbrella comprising:

a canopy;

a shaft eccentrically disposed beneath said canopy;

a runner slidably mounted on said shaft and slidable between a first position, wherein said canopy is collapsed, and a second position, wherein said canopy is extended; and a plurality of rib assemblies forming a canopy supporting frame, each of said rib assemblies being coupled to the apex of said shaft at a proximal end and coupled to said canopy at a distal end, said plurality of rib assemblies further comprising:

a short main rib assembly having a deployment arm and a rib, wherein said deployment arm is coupled to said runner and to said rib, and said rib is coupled to said shaft apex and to said deployment arm; and a long main rib assembly having a deployment arm, a proximal rib, a connecting arm, and a distal rib, wherein said deployment arm is coupled to said runner and to said proximal rib; said proximal rib is coupled at one end to said shaft apex and coupled at another end to said connecting arm; and said connecting arm is coupled to said proximal rib and to said distal rib, wherein the distal end of each of said plurality of rib assemblies points in the same direction when said canopy is collapsed, and wherein said short main rib assembly deployment arm and said long main rib assembly deployment arm are of substantially equal length.

2. The asymmetric umbrella of claim 1, wherein said plurality of rib assemblies are of substantially uniform length when said canopy is collapsed.

3. The asymmetric umbrella of claim 1, wherein said long main rib assembly distal rib is pivotally connected to said connecting arm.

4. The asymmetric umbrella of claim 1, wherein said shaft is attached to said canopy at an attachment point, said attachment point being disposed at a point greater than one-half of the length of said canopy at its widest point.

5. The asymmetric umbrella of claim 1, wherein said shaft is coupled to said canopy at an attachment point, said attachment point being disposed at a point greater than two-thirds of the length of said canopy at its widest point.

6. The asymmetric umbrella of claim 1, wherein said long main rib assembly is at least twice the length of said short main rib assembly.

7. The asymmetric umbrella of claim 1, wherein a support rib is disposed substantially parallel to said long main rib assembly connecting arm to form a quadrilateral hinge joint.

8. The asymmetric umbrella of claim 1, wherein said short main rib assembly deployment arm and said short main rib assembly rib form a short main rib assembly triangular hinge joint with said shaft; and wherein said long main rib assembly deployment arm and said long main rib assembly proximal rib form a long main rib assembly triangular hinge joint with said shaft; said short main rib assembly triangular hinge joint and said long main rib assembly triangular hinge joint having substantially equal angles and proportions.

9. The asymmetric umbrella of claim 1, wherein said short main rib assembly deployment arm is attached to a substantially center point of said short main rib assembly rib and said long main rib assembly deployment arm is attached to a substantially center point of said long main rib assembly proximal rib.

10. The asymmetric umbrella of claim 1, wherein a support rib is disposed substantially parallel to said long main rib assembly connecting arm to form a quadrilateral hinge joint;

said plurality of rib assemblies are of substantially uniform length when said canopy is collapsed;

said shaft is attached to said canopy at an attachment point, said attachment point being disposed at a point greater than one-half of the length of said canopy at its widest point;

said short main rib assembly deployment arm and said short main rib assembly rib form a short main rib assembly triangular hinge joint with said shaft; and wherein said long main rib assembly deployment arm and said long main rib assembly proximal rib form a long main rib assembly triangular hinge joint with said shaft; said short main rib assembly triangular hinge joint and said long main rib assembly triangular hinge joint having substantially equal angles and proportions; and said short main rib assembly deployment arm is attached to a substantially center point of said short main rib assembly rib and said long main rib assembly deployment arm is attached to a substantially center point of said long main rib assembly proximal rib.

11. An asymmetric umbrella comprising:

a canopy;

a shaft eccentrically disposed beneath said canopy;

a runner slidably mounted on said shaft and slidable between a first position, wherein said canopy is collapsed, and a second position, wherein said canopy is extended; and a plurality of rib assemblies forming a canopy supporting frame, each of said rib assemblies being coupled to the apex of said shaft at a proximal end and fixed to said canopy at a free end, said plurality of rib assemblies further comprising:

a short main rib assembly having a deployment arm, a hinge joint, a proximal rib, and a distal rib, wherein said deployment arm is coupled to said runner, said proximal rib, said hinge joint, and said distal rib; and said proximal rib is coupled to said shaft apex, said deployment arm, and said hinge joint; and a long main rib assembly having a deployment arm, a proximal rib, a hinge joint, a first distal rib, a connecting arm, and a second distal rib, wherein said deployment arm is coupled to said runner, said proximal rib, said hinge joint, and said first distal rib; said proximal rib is coupled to said shaft apex, said deployment arm, and said hinge joint; said first distal rib is coupled to said hinge joint, said deployment arm, and said connecting arm; and said second distal rib is coupled to said connecting arm, wherein the free end of each of said rib assemblies points in the same direction when said canopy is collapsed, wherein said plurality of rib assemblies are of substantially the same length when said canopy is collapsed, and wherein said short main rib assembly deployment arm and said long main rib assembly deployment arm are of substantially equal length.

12. The asymmetric umbrella of claim 11, wherein said canopy aids flexion of said short main rib assembly distal rib and said long main rib assembly distal rib when said canopy is extended.

13. The asymmetric umbrella of claim 11, wherein said long main rib distal rib and said short main rib distal rib are formed of a more flexible material than said proximal ribs and said deployment arms.

14. The asymmetric umbrella of claim 11, wherein said shaft is attached to said canopy at an attachment point, said attachment point being disposed at a point greater than one-half of the length of said canopy at its widest point.

15. The asymmetric umbrella of claim 11, wherein said shaft is coupled to said canopy at an attachment point, said attachment point being disposed at a point greater than two-thirds of the length of said canopy at its widest point.

16. The asymmetric umbrella of claim 11, wherein said long main rib assembly is at least twice the length of said short main rib assembly.

17. The asymmetric umbrella of claim 11, wherein each of said long main rib assembly hinge joint and said short main rib assembly hinge joint comprises a support rib.

18. The asymmetric umbrella of claim 17, wherein each support rib is disposed substantially parallel to the deployment arm in its respective rib assembly to form quadrilateral hinge joints.

19. The asymmetric umbrella of claim 11, wherein a support rib is disposed substantially parallel to said long main rib assembly connecting arm to form a quadrilateral hinge joint.

20. The asymmetric umbrella of claim 11, wherein said short main rib assembly deployment arm and said short main rib assembly proximal rib form a short main rib assembly triangular hinge joint with said shaft and wherein said long main rib assembly deployment arm and said long main rib assembly proximal rib form a long main rib assembly triangular hinge joint with said shaft, said short main rib assembly triangular hinge joint and said long main rib assembly triangular hinge joint having substantially equal angles and proportions.

21. The asymmetric umbrella of claim 11, wherein said short main rib assembly proximal rib is attached to a substantially center point of said short main rib assembly deployment arm and said long main rib assembly proximal rib is attached to a substantially center point of said long main rib assembly deployment arm.

22. The asymmetric umbrella of claim 11, wherein said short main rib assembly hinge joint and said long main rib assembly hinge joint are quadrilateral hinge joints.

23. The asymmetric umbrella of claim 11, wherein each of said long main rib assembly hinge joint and said short main rib assembly hinge joint comprises a support rib that is disposed substantially parallel to the deployment arm in its respective rib assembly to form quadrilateral hinge joints;

a support rib is disposed substantially parallel to said long main rib assembly connecting arm to form a quadrilateral hinge joint;

said shaft is attached to said canopy at an attachment point, said attachment point being disposed at a point greater than one-half of the length of said canopy at its widest point;

said short main rib assembly deployment arm and said short main rib assembly proximal rib form a short main rib assembly triangular hinge joint with said shaft and wherein said long main rib assembly deployment arm and said long main rib assembly proximal rib form a long main rib assembly triangular hinge joint with said shaft, said short main rib assembly triangular hinge joint and said long main rib assembly triangular hinge joint having substantially equal angles and proportions; and said short main rib assembly proximal rib is attached to a substantially center point of said short main rib assembly deployment arm and said long main rib assembly proximal rib is attached to a substantially center point of said long main rib assembly deployment arm.

24. An asymmetric umbrella comprising:

a canopy;

a shaft eccentrically disposed beneath said canopy;

a runner slidably mounted on said shaft and slidable between a first position, wherein said canopy is collapsed, and a second position, wherein said canopy is extended; and a plurality of rib assemblies forming a canopy supporting frame, each of said rib assemblies being coupled to the apex of said shaft at a proximal end and coupled to said canopy at a distal end, said plurality of rib assemblies further comprising:

a short main rib assembly having a deployment arm and a rib, wherein said deployment arm is coupled to said runner and to said rib, and said rib is coupled to said shaft apex and to said deployment arm; and a long main rib assembly having a deployment arm, a first rib, a connecting arm, and a second rib, wherein said deployment arm is coupled to said runner and to said first rib; said first rib is coupled at one end to said shaft apex and coupled at another end to said connecting arm; and said connecting arm is coupled to said first rib and to said second rib, wherein the distal end of each of said plurality of rib assemblies points in the same direction when said canopy is collapsed.

25. The asymmetric umbrella of claim 24, wherein said plurality of rib assemblies are of substantially uniform length when said canopy is collapsed.

26. The asymmetric umbrella of claim 24, wherein said short main rib assembly deployment arm and said long main rib assembly deployment arm are of substantially equal length.

27. The asymmetric umbrella of claim 24, wherein said shaft is attached to said canopy at an attachment point, said attachment point being disposed at a point greater than one-half of the length of said canopy at its widest point.

28. The asymmetric umbrella of claim 24, wherein said shaft is coupled to said canopy at an attachment point, said attachment point being disposed at a point greater than two-thirds of the length of said canopy at its widest point.

29. The asymmetric umbrella of claim 24, wherein said long main rib assembly is at least twice the length of said short main rib assembly.

30. The asymmetric umbrella of claim 24, wherein a support rib is disposed substantially parallel to said connecting arm to form a quadrilateral hinge joint.

31. The asymmetric umbrella of claim 24, wherein said short main rib assembly deployment arm and said short main rib assembly rib form a short main rib assembly triangular hinge joint with said shaft; and wherein said long main rib assembly deployment arm and said long main rib assembly first rib form a long main rib assembly triangular hinge joint with said shaft; said short main rib assembly triangular hinge joint and said long main rib assembly triangular hinge joint having substantially equal angles and proportions.

32. The asymmetric umbrella of claim 24, wherein said short main rib assembly deployment arm is attached to a substantially center point of said short main rib assembly rib and said long main rib assembly deployment arm is attached to a substantially center point of said long main rib assembly first rib.

33. The asymmetric umbrella of claim 24, wherein a support rib is disposed substantially parallel to said connecting arm to form a quadrilateral hinge joint;

said plurality of rib assemblies are of substantially uniform length when said canopy is collapsed;

said short main rib assembly deployment arm and said long main rib assembly deployment arm are of substantially equal length;

said shaft is attached to said canopy at an attachment point, said attachment point being disposed at a point greater than one-half of the length of said canopy at its widest point;

said short main rib assembly deployment arm and said short main rib assembly rib form a short main rib assembly triangular hinge joint with said shaft; and wherein said long main rib assembly deployment arm and said long main rib assembly first rib form a long main rib assembly triangular hinge joint with said shaft; said short main rib assembly triangular hinge joint and said long main rib assembly triangular hinge joint having substantially equal angles and proportions; and said short main rib assembly deployment arm is attached to a substantially center point of said short main rib assembly rib and said long main rib assembly deployment arm is attached to a substantially center point of said long main rib assembly first rib.

34. An asymmetric umbrella comprising:

a canopy;

a shaft eccentrically disposed beneath said canopy;

a runner slidably mounted on said shaft and slidable between a first position, wherein said canopy is collapsed, and a second position, wherein said canopy is extended; and a plurality of rib assemblies forming a canopy supporting frame, each of said rib assemblies being coupled to the apex of said shaft at a proximal end and fixed to said canopy at a distal end, said plurality of rib assemblies further comprising:

a short main rib assembly having a deployment arm, a first rib, and a second rib, wherein said deployment arm is coupled to said runner, said first rib, and said second rib; and said first rib is coupled to said shaft apex, and said deployment arm; and a long main rib assembly having a deployment arm, a first rib, a second rib, a connecting arm, and a third rib, wherein said deployment arm is coupled to said runner, said first rib, and said second rib; said first rib is coupled to said shaft apex and said deployment arm; said second rib is coupled to said deployment arm and said connecting arm; and said third rib is coupled to said connecting arm, wherein the distal end of each of said rib assemblies points in the same direction when said canopy is collapsed, and wherein said plurality of rib assemblies are of substantially uniform length when said canopy is collapsed.

35. The asymmetric umbrella of claim 34, wherein said short main rib assembly deployment arm and said long main rib assembly deployment arm are of substantially equal length.

36. The asymmetric umbrella of claim 34, wherein a support rib is disposed substantially parallel to the long main rib assembly deployment arm to form a quadrilateral hinge joint.

37. The asymmetric umbrella of claim 34, wherein a support rib is disposed substantially parallel to the short main rib assembly deployment arm to form a quadrilateral hinge joint.

38. The asymmetric umbrella of claim 34, wherein a support rib is disposed substantially parallel to the long main rib assembly second rib to form a quadrilateral hinge joint.

39. The asymmetric umbrella of claim 34, wherein a support rib is disposed substantially parallel to the long main rib assembly connecting arm to form a quadrilateral hinge joint.

40. The asymmetric umbrella of claim 34, wherein said shaft is attached to said canopy at an attachment point, said attachment point being disposed at a point greater than one-half of the length of said canopy at its widest point.

41. The asymmetric umbrella of claim 34, wherein said shaft is coupled to said canopy at an attachment point, said attachment point being disposed at a point greater than two-thirds of the length of said canopy at its widest point.

42. The asymmetric umbrella of claim 34, wherein said long main rib assembly is at least twice the length of said short main rib assembly.

43. The asymmetric umbrella of claim 34, wherein said short main rib assembly deployment arm and said short main rib assembly first rib form a short main rib assembly triangular hinge joint with said shaft and wherein said long main rib assembly deployment arm and said long main rib assembly first rib form a long main rib assembly triangular hinge joint with said shaft, said short main rib assembly triangular hinge joint and said long main rib assembly triangular hinge joint having substantially equal angles and proportions.

44. The asymmetric umbrella of claim 34, wherein said short main rib assembly first rib is attached to a substantially center point of said short main rib assembly deployment arm and said long main rib assembly first rib is attached to a substantially center point of said long main rib assembly deployment arm.

45. The asymmetric umbrella of claim 34, wherein a support rib is disposed substantially parallel to each of said short main rib assembly deployment arm, said long main rib assembly deployment arm, said long main rib assembly second rib, and said long main rib assembly connecting arm;

said short main rib assembly deployment arm and said long main rib assembly deployment arm are of substantially equal length;

said shaft is attached to said canopy at an attachment point, said attachment point being disposed at a point greater than one-half of the length of said canopy at its widest point;

said short main rib assembly deployment arm and said short main rib assembly first rib form a short main rib assembly triangular hinge joint with said shaft and wherein said long main rib assembly deployment arm and said long main rib assembly first rib form a long main rib assembly triangular hinge joint with said shaft, said short main rib assembly triangular hinge joint and said long main rib assembly triangular hinge joint having substantially equal angles and proportions; and said short main rib assembly first rib is attached to a substantially center point of said short main rib assembly deployment arm and said long main rib assembly first rib is attached to a substantially center point of said long main rib assembly deployment arm.

* * * * *